US011188032B2

(12) United States Patent
Bahr et al.

(10) Patent No.: US 11,188,032 B2
(45) **Date of Patent: *Nov. 30, 2021**

(54) MOLECULAR CLOCK WITH DELAY COMPENSATION

(71) Applicant: TEXAS INSTRUMENTS INCORPORATED, Dallas, TX (US)

(72) Inventors: Bichoy Bahr, Allen, TX (US); Argyrios Dellis, McKinney, TX (US); Adam Fruehling, Garland, TX (US); Juan Alejandro Herbsommer, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 127 days.

This patent is subject to a terminal disclaimer.

(21) Appl. No.: 16/589,176

(22) Filed: Oct. 1, 2019

(65) Prior Publication Data

US 2020/0257250 A1 Aug. 13, 2020

Related U.S. Application Data

(60) Provisional application No. 62/803,271, filed on Feb. 8, 2019.

(51) Int. Cl.
*G04F 5/00* (2006.01)

(52) U.S. Cl.
CPC ..... *G04F 5/00* (2013.01)

(58) Field of Classification Search
CPC ..... G04F 5/00; H03L 7/26
USPC ..... 368/327; 331/3, 94.1
See application file for complete search history.

(56) References Cited

U.S. PATENT DOCUMENTS

| | | | | |
|---|---|---|---|---|
| 4,449,105 | A * | 5/1984 | Frank | H03L 7/26 331/3 |
| 10,620,589 | B1 * | 4/2020 | Bahr | G04F 5/14 |
| 2019/0204787 | A1 * | 7/2019 | Herbsommer | G04F 5/14 |
| 2019/0204788 | A1 * | 7/2019 | Dellis | G04F 5/14 |
| 2019/0235445 | A1 * | 8/2019 | Han | H03L 7/099 |

* cited by examiner

*Primary Examiner* — Joseph Chang
(74) *Attorney, Agent, or Firm* — Michael A. Davis, Jr.; Charles A. Brill; Frank D. Cimino

(57) ABSTRACT

A clock generator includes a hermetically sealed cavity and clock generation circuitry. A dipolar molecule in the hermetically sealed cavity has a quantum rotational state transition at a fixed frequency. The clock generation circuitry generates an output clock signal based on the fixed frequency of the dipolar molecule. The clock generation circuitry includes a detection circuit, a reference oscillator, and control circuitry. The detection circuit generates a first detection signal and a second detection signal representative of amplitude of signal at an output of the hermetically sealed cavity responsive to a first sweep signal and a second sweep signal input to the hermetically sealed cavity. The control circuitry sets a frequency of the reference oscillator based on a difference in time of identification of the fixed frequency of the dipolar molecule in the first detection signal and the second detection signal.

20 Claims, 6 Drawing Sheets

MOLECULAR CLOCK WITH DELAY COMPENSATION

CROSS-REFERENCE TO RELATED APPLICATIONS

The present application claims priority to U.S. Provisional Patent Application No. 62/803,271, filed Feb. 8, 2019, entitled "Molecular Clock with FMCW Chirps Delay Compensation," which is hereby incorporated herein by reference in its entirety.

BACKGROUND

An atomic clock is an oscillator that provides a highly stable frequency over a long period of time because its resonance frequency is determined by the energy transition of atoms. In contrast, the frequency of a crystal oscillator is determined by the length of the crystal and is therefore much more susceptible to temperature variations than an atomic clock.

Atomic clocks are utilized in various systems that require extremely accurate and stable frequencies, such as in bistatic radars, GPS (global positioning system) and other navigation and positioning systems, as well as in various communications systems (e.g., cellular telephone systems).

In one type of atomic clock, a cell contains an active medium such as cesium (or rubidium) vapor. An optical pumping device, such as a laser diode transmits a light beam of a particular wavelength through the vapor, which is excited to a higher state. Absorption of the light in pumping the atoms of the vapor to the higher state is sensed by a photodetector which provides an output signal proportional to the light beam impinging on the detector.

By examining the output of the photodetector, a control system provides various control signals to ensure that the wavelength of the propagated light is precisely controlled.

SUMMARY

Molecular clock generators that include compensation for delay in circuitry that detects signal output from a hermetically sealed cavity are disclosed herein. In one example, a clock generator includes a hermetically sealed cavity and clock generation circuitry. A dipolar molecule is disposed in the hermetically sealed cavity, and has a quantum rotational state transition at a fixed frequency. The clock generation circuitry is configured to generate an output clock signal based on the fixed frequency of the dipolar molecule. The clock generation circuitry includes a detection circuit, a reference oscillator, and control circuitry. The detection circuit is coupled to the hermetically sealed cavity, and is configured to generate a first detection signal representative of an amplitude of a signal at an output of the hermetically sealed cavity responsive to a first sweep signal input to the hermetically sealed cavity, and to generate a second detection signal representative of the amplitude of the signal at the output of the hermetically sealed cavity responsive to a second sweep signal input to the hermitically sealed cavity. The reference oscillator is configured to generate an oscillator signal based on the fixed frequency of the dipolar molecule. The control circuitry is coupled to the detection circuit and the reference oscillator. The control circuitry is configured to set a frequency of the reference oscillator based on a difference in a time of identification of the fixed frequency of the dipolar molecule in the first detection signal and a time of identification of the fixed frequency of the dipolar molecule in the second detection signal.

In another example, a method for clock generation includes transmitting a first sweep signal and a second sweep signal into a hermetically sealed cavity. The hermetically sealed cavity contains a dipolar molecule that has a quantum rotational state transition at a fixed frequency. A first output of the hermetically sealed cavity produced responsive to the first sweep signal is detected, and a first detection signal representative of an amplitude of the first output of the hermetically sealed cavity is generated. A second output of the hermetically sealed cavity produced responsive to the second sweep signal is detected, and a second detection signal representative of an amplitude of the second output of the hermetically sealed cavity is generated. A frequency of a reference oscillator is set based on a difference in a time of identification of the fixed frequency of the dipolar molecule in the first detection signal and a time of identification of the fixed frequency of the dipolar molecule in the second detection signal.

In a further example, a clock generator includes a hermetically sealed cavity and clock generation circuitry. A dipolar molecule is disposed in the hermetically sealed cavity, and has a quantum rotational state transition at a fixed frequency. The clock generation circuitry is configured to generate an output clock signal based on the fixed frequency of the dipolar molecule. The clock generation circuitry includes a reference oscillator, a phase locked loop (PLL), a detection circuit, and control circuitry. The reference oscillator is configured to generate an oscillator signal based on the fixed frequency of the dipolar molecule. The PLL is coupled to the reference oscillator and to the hermetically sealed cavity, and is configured to generate a first sweep signal and a second sweep signal. The detection circuit is coupled to the hermetically sealed cavity. The detection circuit is configured to generate a first detection signal representative of an amplitude of a signal at an output of the hermetically sealed cavity responsive to the first sweep signal being input to the hermetically sealed cavity, and to generate a second detection signal representative of the amplitude of the signal at the output of the hermetically sealed cavity responsive to the second sweep signal being input to the hermitically sealed cavity. The control circuitry is coupled to the detection circuit, the PLL, and the reference oscillator. The control circuitry is configured to set a frequency of the reference oscillator based on a difference in a time of identification of the fixed frequency of the dipolar molecule in the first detection signal and a time of identification of the fixed frequency of the dipolar molecule in the second detection signal.

BRIEF DESCRIPTION OF THE DRAWINGS

For a detailed description of various examples, reference will now be made to the accompanying drawings in which.

DETAILED DESCRIPTION

In this description, the term "couple" or "couples" means either an indirect or direct connection. Thus, if a first device couples to a second device, that connection may be through a direct connection or through an indirect connection via other devices and connections. Also, in this description, the recitation "based on" means "based at least in part on."

In a millimeter wave chip scale molecular clock, a dipolar molecule is used to set the frequency of a clock signal. The dipolar molecule has quantum rotational states that can be measured through electromagnetic wave absorption. A peak value of electromagnetic wave absorption that occurs at a fixed and known frequency is monitored and applied to control the frequency of the clock signal. In some implementations, frequency shift keying (FSK) is used identify the absorption peak by balancing the amplitude of two FSK tones on either side of the absorption peak. In other implementations, analog sinusoidal frequency modulation (FM) is used to continuously sweep the absorption peak. In other implementations, frequency modulated continuous wave (FMCW) excitation, rather than FSK or FM, is used to identify the absorption peak.

In a molecular clock using FMCW, the delay of receiver circuitry that detects signal output of a cavity containing the dipolar molecule may be interpreted as drift of a reference oscillator. As a result, the frequency of the reference oscillator may be adjusted to correct for a non-existent error, which introduces an error into the reference clock frequency. The delay of the receiver circuitry can vary based on temperature, stress, aging, and other environmental factors. Thus, the delay of the receiver circuitry can significantly affect the stability of the clock signal generated by the reference oscillator.

The molecular clock generators disclosed herein compensate for the delay of the receiver circuitry to reduce frequency error caused by the delay. The molecular clock generators use FMCW chirps (sweeps) with up and down ramp slopes. Reference frequency drift affects the up and down ramp slopes differently. If the reference frequency increases, the molecular absorption peak of the dipolar molecule appears to happen earlier in time for the up sweep, whereas the molecular absorption peak appears to happen later in time for the down sweep. The delay of the receiver circuitry affects both sweeps in the same way. That is, the delay of the receiver circuitry delays the molecular absorption peak in time for both up and down sweeps. The molecular clock generators described herein determine the difference between the timing of the molecular absorption peak in the up sweep and down sweep to obtain a measurement of the reference frequency drift that is unaffected by the delay of the receiver circuitry. The molecular clock generators apply the measurement of reference frequency drift to adjust the reference frequency.

Figure 1:
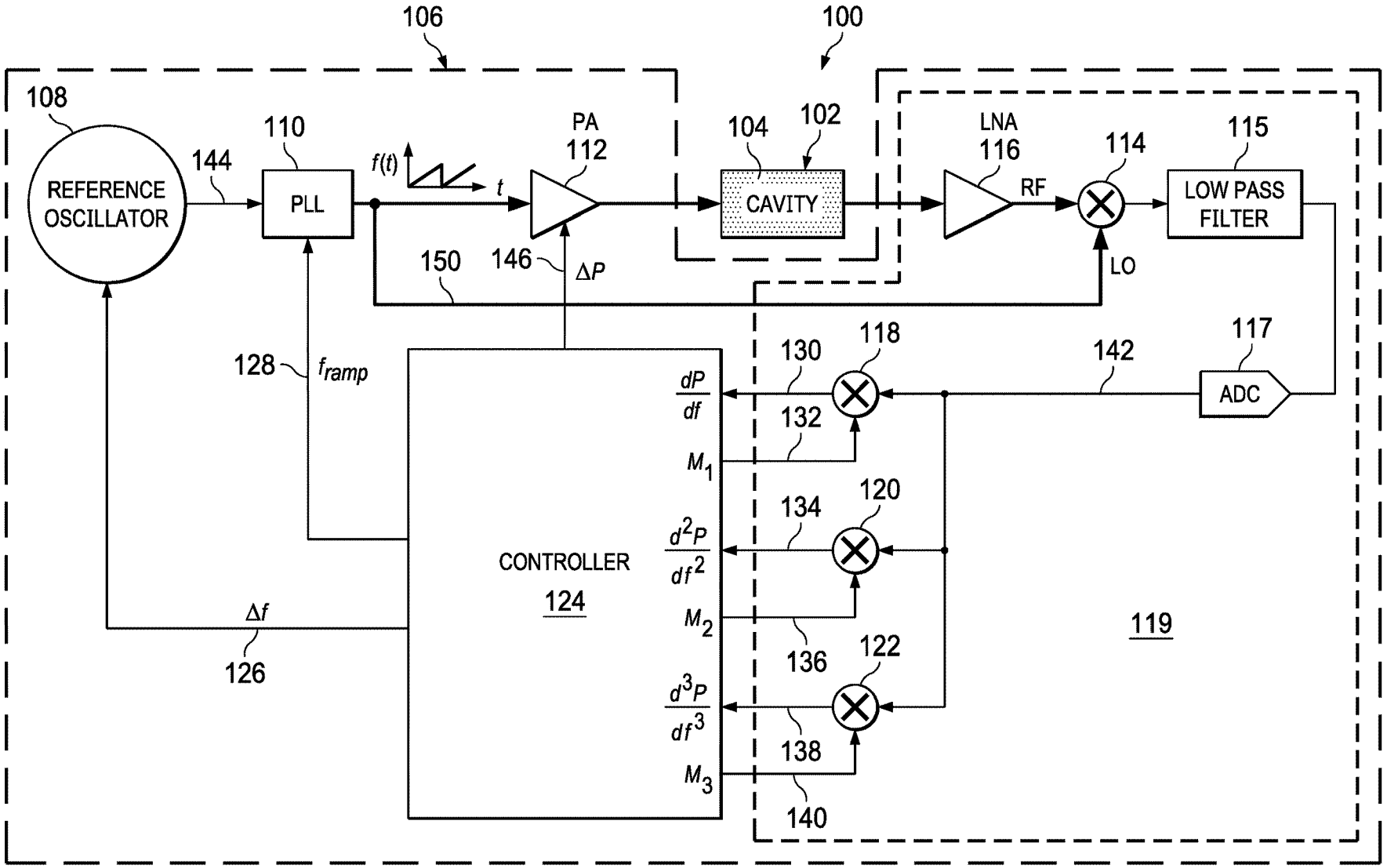
FIG. 1 shows a block diagram for an example molecular clock generator in accordance with this description.

FIG. 1 shows a block diagram for an example molecular clock generator 100 in accordance with this description. The molecular clock generator 100 includes a cavity 102 that contains a dipolar molecule 104, and includes clock generation circuitry 106 that interrogates the dipolar molecule 104. The cavity 102 is hermitically sealed. In some implementations, the dipolar molecule 104 may be a water molecule, a carbonyl sulfide molecule, a hydrogen cyanide molecule, etc. The cavity 102 operates as a waveguide to direct electromagnetic signal from a cavity input port to a cavity output port. The cavity 102 may be constructed via a microelectromechanical system (MEMS) fabrication process in a silicon substrate, a ceramic substrate, or other suitable substrate.

The clock generation circuitry 106 includes circuitry that drives electromagnetic signal into the cavity 102, receives electromagnetic signal from the cavity 102, and generates an oscillator signal locked to an absorption peak of the dipolar molecule 104 disposed in the cavity 102. More specifically, the clock generation circuitry 106 includes a reference oscillator 108, a phase-locked-loop (PLL) 110, a power amplifier 112, a detection circuit 119, and a controller 124. The detection circuit 119 is coupled to the cavity 102 and the controller 124. The detection circuit 119 includes a low-noise amplifier (LNA) 116, a mixer 114, a low pass filter 115, an analog-to-digital converter (ADC) 117, a multiplier 118, a multiplier 120, and a multiplier 122. Some implementations of the clock generation circuitry 106 include an amplitude detector circuit or a peak detector circuit rather than the mixer 114.

The reference oscillator 108 is an oscillator that is adjustable via the control signal 126. For example, the reference oscillator 108 may be a crystal oscillator having an output frequency that can be varied over a narrow range by changing the control signal 126. In various implementations, the reference oscillator 108 is a voltage-controlled crystal oscillator (VCXO), a voltage-controlled temperature compensated crystal oscillator (VCTCXO), or a voltage-controlled oscillator (VCO). The output 144 of the reference oscillator 108 is provided to the PLL 110. The output 144 of the reference oscillator 108 may also be provided to a driver circuit (not shown) for provision to circuits external to the molecular clock generator 100.

The PLL 110 is coupled to the reference oscillator 108, and includes circuits to multiply the frequency of the output 144 up to a range that includes the frequency of the selected absorption peak of the dipolar molecule 104. The PLL 110 may include a phase detector, a filter, counters, and other circuitry for PLL frequency multiplication. The output frequency of the PLL 110 can also be varied by a ramp control signal 128. For example, the output frequency of the PLL 110 may be centered at a fixed multiple of the frequency of the output 144 and varied over a range that includes frequencies below and above the center frequency by changing the ramp control signal 128. For example, the ramp control signal 128 may change a divider value in the PLL 110 or modulate a VCO control voltage in the PLL 110. In this way, the PLL 110 may generate a frequency sweep about the absorption peak of the dipolar molecule 104. The sweep signal 150 of the PLL 110 is provided to the power amplifier 112.

The power amplifier 112 is coupled to the PLL 110 and the cavity 102, and includes circuitry for amplifying the sweep signal 150 of the PLL 110 and driving the cavity 102. The power amplifier 112 may include circuitry for applying voltage gain and/or current gain to the sweep signal 150 of the PLL 110. The output power of the power amplifier 112 is variable via the control signal 146. Some implementations of the 106 may omit the power amplifier 112. For example, if the output power of the PLL 110 is sufficient to drive the cavity 102, then the PLL 110 may be omitted.

The cavity 102 includes an input port and an output port. The electromagnetic signal generated by the power amplifier 112 propagates through the cavity 102 from the input port to the output port. The dipolar molecule 104 has an absorption peak at a frequency of quantum rotational state transition that reduces the amplitude of the electromagnetic signal at the output port at the absorption peak. The LNA 116 is coupled to the output port of the cavity 102. The LNA 116 amplifies the signal received from the cavity 102, and provides an amplified LNA output signal to the mixer 114. Some implementations of the 106 may omit the LNA 116. For example, if the output power of the cavity 102 is sufficient to drive the mixer 114, then the LNA 116 may be omitted.

The mixer 114 multiplies the signal output from the cavity 102 and the sweep signal 150 of the PLL 110. A low pass filter 115 filters the output of the mixer 114 to generate a detection signal that is representative of the amplitude of the signal received from the cavity 102 (signal at the output port of the cavity 102) at the frequency generated by the PLL 110.

In implementations of the clock generation circuitry 106 that include an amplitude detector circuit rather than the mixer 114, the amplitude detector circuit receives the amplified LNA output signal and generates an envelope signal without use of the sweep signal 150 of the PLL 110.

Figure 2:
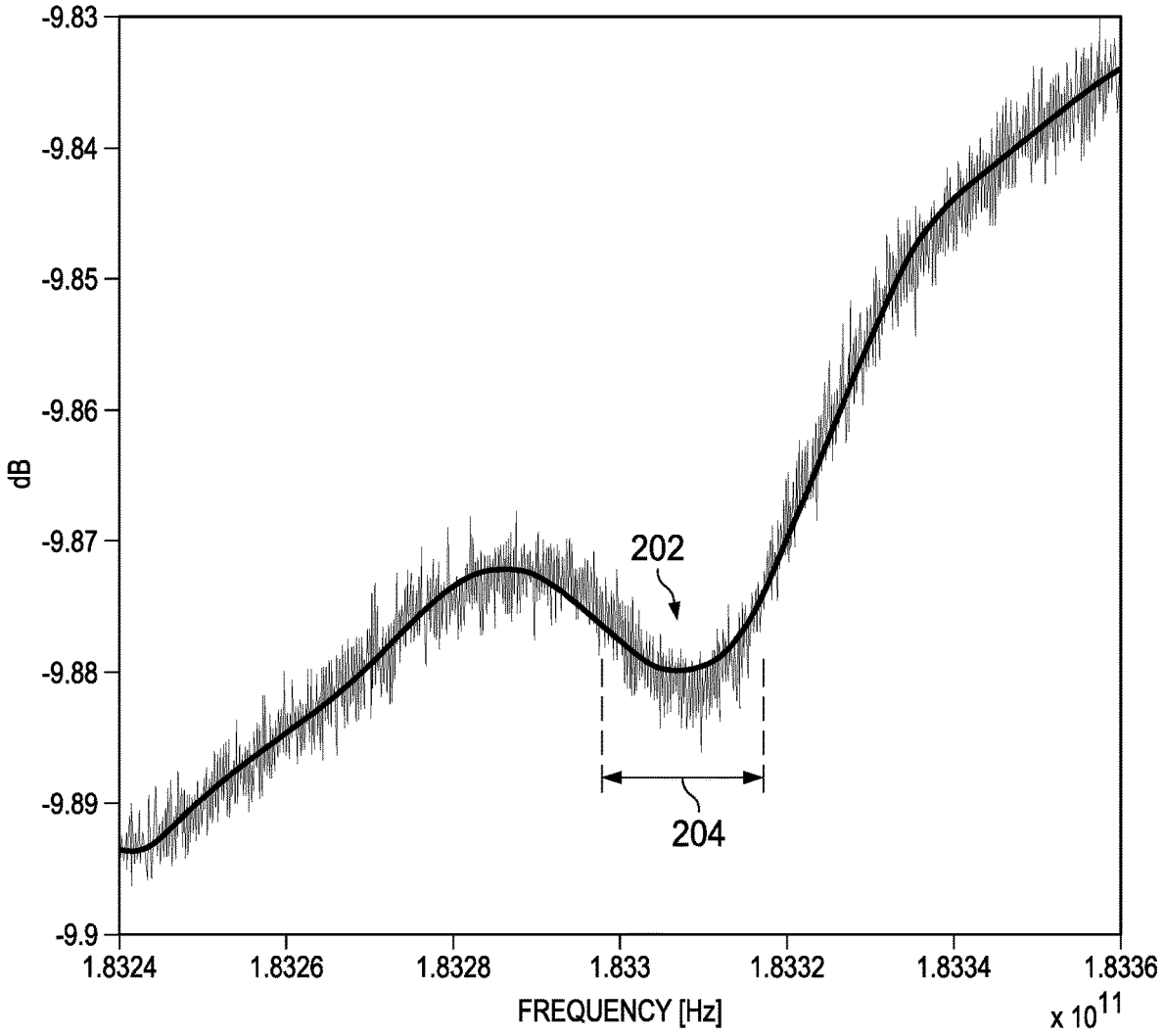
FIG. 2 show an example of an absorption peak in a molecular clock generator in accordance with this description.

FIG. 2 show an example of an absorption peak 202 in the molecular clock generator 100 and the power signal generated by the detection circuit 119. An example of the range of frequencies swept by the PLL 110 is illustrated as frequency range 204. The absorption peak of the dipolar molecule 104, which is water in this example, is at 183.31 gigahertz (GHz).

Output of the low pass filter 115 is digitized by the ADC 117, and output of the ADC 117 is provided to the multiplier 118, the multiplier 120, and the multiplier 122. The multiplier 118 multiples the ADC output signal 142 by a mixer signal 132. The average of the product of the ADC output signal 142 and the mixer signal 132 is the first derivative 130 of the ADC output signal 142. The multiplier 120 multiples the ADC output signal 142 by a mixer signal 136. The average of the product of the ADC output signal 142 and the mixer signal 136 is the second derivative 134 of the ADC output signal 142. The multiplier 122 multiples the ADC output signal 142 by a mixer signal 140. The average of the product of the ADC output signal 142 and the mixer signal 140 is the third derivative 138 of the ADC output signal 142.

The multiplier 118, the multiplier 120, and the multiplier 122 are coupled to the controller 124. In some implementations of the molecular clock generator 100, the multiplier 118, the multiplier 120, and the multiplier 122 are included in the controller 124. The controller 124 provides the mixer signal 132, the mixer signal 136, and the mixer signal 140 to the multiplier 118, the multiplier 120, and the multiplier 122 respectively. The controller 124 receives the first derivative 130 generated by the multiplier 118, the second derivative 134 generated by the multiplier 120, and the third derivative 138 generated by the multiplier 122. The controller 124 applies the first derivative 130, the second derivative 134, and the third derivative 138 to control the reference oscillator 108, the PLL 110, and the power amplifier 112.

Figure 3A:
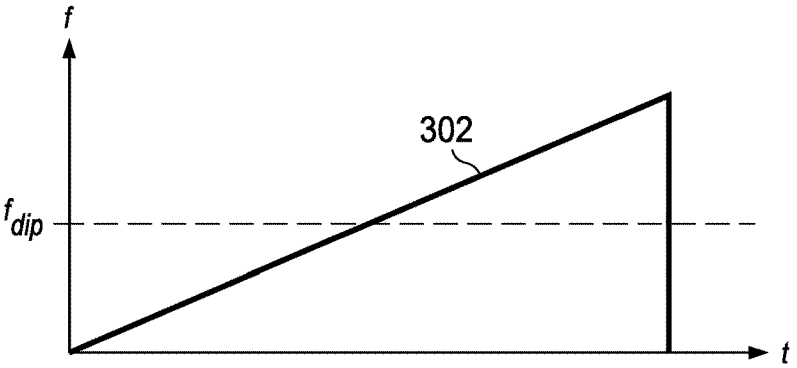
FIG. 3A shows frequency of an example sweep signal generated in an implementation of a molecular clock generator.

FIG. 3A shows frequency of an example sweep signal 302 generated by the PLL 110. The sweep signal 302 is an example of the sweep signal 150. In this example, the sweep signal 302 linearly increases in frequency from a frequency below the absorption peak ($f_{dip}$) of the dipolar molecule 104 to a frequency above $f_{dip}$. The instantaneous frequency of the sweep signal 302 may be expressed as:

$$f(t)=f_0\times(M+Rt)$$

where:

$f_0$ is the frequency of the reference oscillator 108; and

M and R are stable digitally generated values.

Figure 3B:
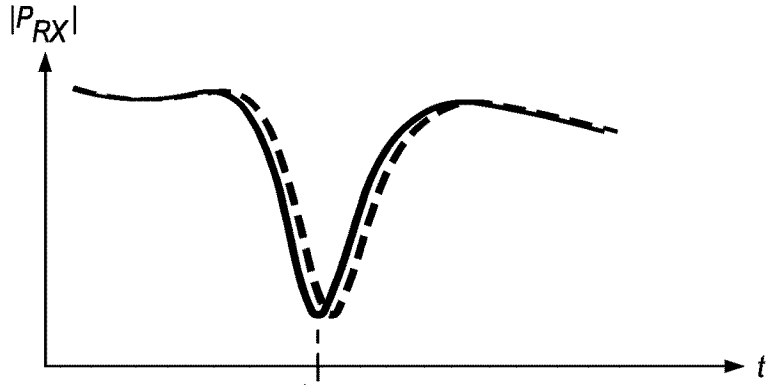
FIG. 3B shows the absorption peak of a dipolar molecule as power output of a cavity during a sweep signal.

FIG. 3B shows the absorption peak ($f_{dip}$) of the dipolar molecule 104 as power output of the cavity 102 during the sweep signal 302, with timing of $f_{dip}$ shown as $t_{dip}$.

In the molecular clock generator 100, the controller 124 makes adjustments to the frequency of the reference oscillator 108 based on measurements of the time ($t_{dip}$) at which $f_{dip}$ is detected. $t_{dip}$ may be expressed as:

$$t_{dip} = \frac{1}{R}\left(\frac{f_{dip}}{f_o} - M\right) + t_{gRX}$$

where $t_{gRX}$ is the group delay of the detection circuit 119, which varies with temperature, power supply voltage, aging, and various other factors.

Change in $t_{dip}$ may be expressed as:

$$\Delta t_{dip} = -\frac{1}{R}\frac{f_{dip}}{f_o}\frac{\Delta f_o}{f_o} + \Delta t_{gRX}$$

In terms of sampling of the ADC 117, where time is measured in sample increments:

$$n_{dip} = \frac{R_{ADC}}{R}\left(\frac{f_{dip}}{f_o} - M\right) + \frac{t_{gRX}}{R}, \text{ and}$$

$$\Delta n_{dip} = -\frac{R_{ADC}}{R}\frac{f_{dip}}{f_o}\frac{\Delta f_o}{f_o} + \frac{\Delta t_{gRX}}{R}$$

While integer sample numbers are generally used, in the foregoing equations sample numbers are used as a unit of time measurement. Therefore, units of 0.1 sample, $1\times10^{-9}$ sample, etc. may be used. For example, $\Delta n_{dip}=1\times10^{-9}$ is a valid measurement of change in units of samples.

Thus, in some implementations of the molecular clock generator 100, the controller 124 may adjust the frequency ($f_0$) of the reference oscillator 108 as a result of changes in $f_0$ or changes in the delay ($t_{gRX}$) of the detection circuit 119. Adjusting the frequency of the controller 124 based on the changes in the delay of the detection circuit 119 is undesirable because the delay is unrelated to the frequency of the reference oscillator 108.

In some implementations of the molecular clock generator 100, the controller 124 measures the timing of the absorption peak in a way that compensates for the delay of the detection circuit 119. In such implementations, the controller 124 generates a first instance of the ramp control signal 128 that causes the sweep signal 150 to sweep across $f_{dip}$ from a lower frequency to a higher frequency (i.e., an up ramp in frequency), and generates a second instance of the ramp control signal 128 that causes the sweep signal 150 to sweep across $f_{dip}$ from a higher frequency to a lower frequency (i.e., a down ramp in frequency). The controller 124 measures the time from initiation of each sweep to the absorption peak, computes the difference of the measured absorption peak times to cancel the delay of the detection circuit 119, and sets the reference oscillator 108 based on the difference value.

Figure 4A:
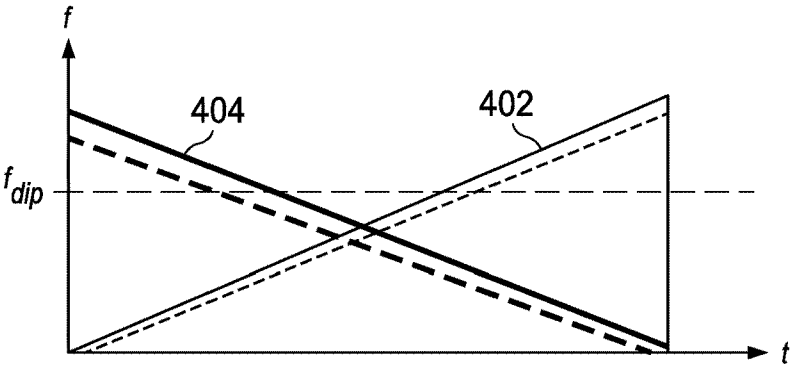
FIG. 4A shows frequency of a first sweep signal and a second sweep signal generated in a molecular clock generator in accordance with this description.

FIG. 4A shows frequency of an example sweep signal 402 and an example sweep signal 404 generated by the PLL 110. The sweep signal 402 and the sweep signal 404 are examples of the sweep signal 150. In this example, the sweep signal 402 linearly increases in frequency from a frequency below the absorption peak ($f_{dip}$) of the dipolar molecule 104 to a frequency above $f_{dip}$ (i.e., a positive linear frequency ramp), and the sweep signal 404 linearly decreases in frequency from a frequency above $f_{dip}$ to a frequency below $f_{dip}$ (i.e., a negative linear frequency ramp). The controller 124 may generate the sweep signal 404 and the sweep signal 402 successively, so that one immediately precedes the other.

The instantaneous frequency of the sweep signal 402 may be expressed as:

$$f_{up}(t)=f_0\times(M+Rt)$$

The instantaneous frequency of the sweep signal 404 may be expressed as:

$$f_{down}(t)=f_0\times(M-Rt)$$

Figure 4B:
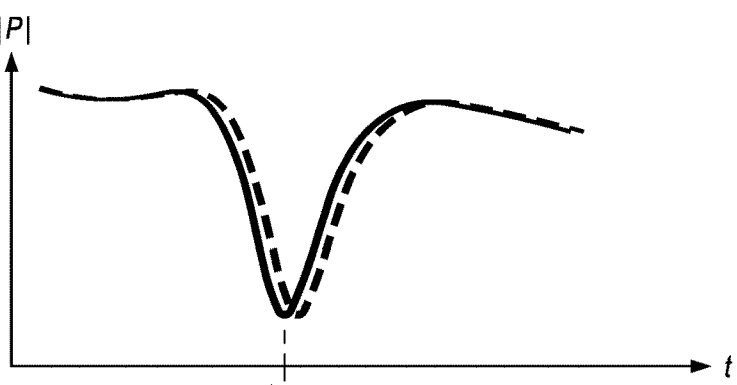
FIG. 4B shows the absorption peak of a dipolar molecule as power output of a cavity during a sweep signal.

FIG. 4B shows the absorption peak ($f_{dip}$) of the dipolar molecule 104 as power output of the cavity 102 during the sweep signal 150, with timing of $f_{dip}$ shown as $t_{dip}$.

In the up ramp, the timing of the absorption peak ($t_{dip_up}$) is expressed as:

$$t_{dip_up}=\frac{1}{R}\left(\frac{f_{dip}}{f_o}-M\right)+t_{gRX}$$

In the down ramp, the timing of the absorption peak ($t_{dip_down}$) is expressed as:

$$t_{dip_down}=\frac{1}{R}\left(M-\frac{f_{dip}}{f_o}\right)+t_{gRX}$$

The difference of $t_{dip_up}$ and $t_{dip_down}$ down cancels $t_{gRX}$ as:

$$t_{dip_up}-t_{dip_down}=\frac{2}{R}\frac{f_{dip}}{f_o}-\frac{2M}{R}$$

In terms of sampling of the ADC 117:

$$\Delta n_{dip}=\frac{2R_{ADC}}{R}\frac{f_{dip}}{f_o}\frac{\Delta f_0}{f_o}$$

Figure 5:
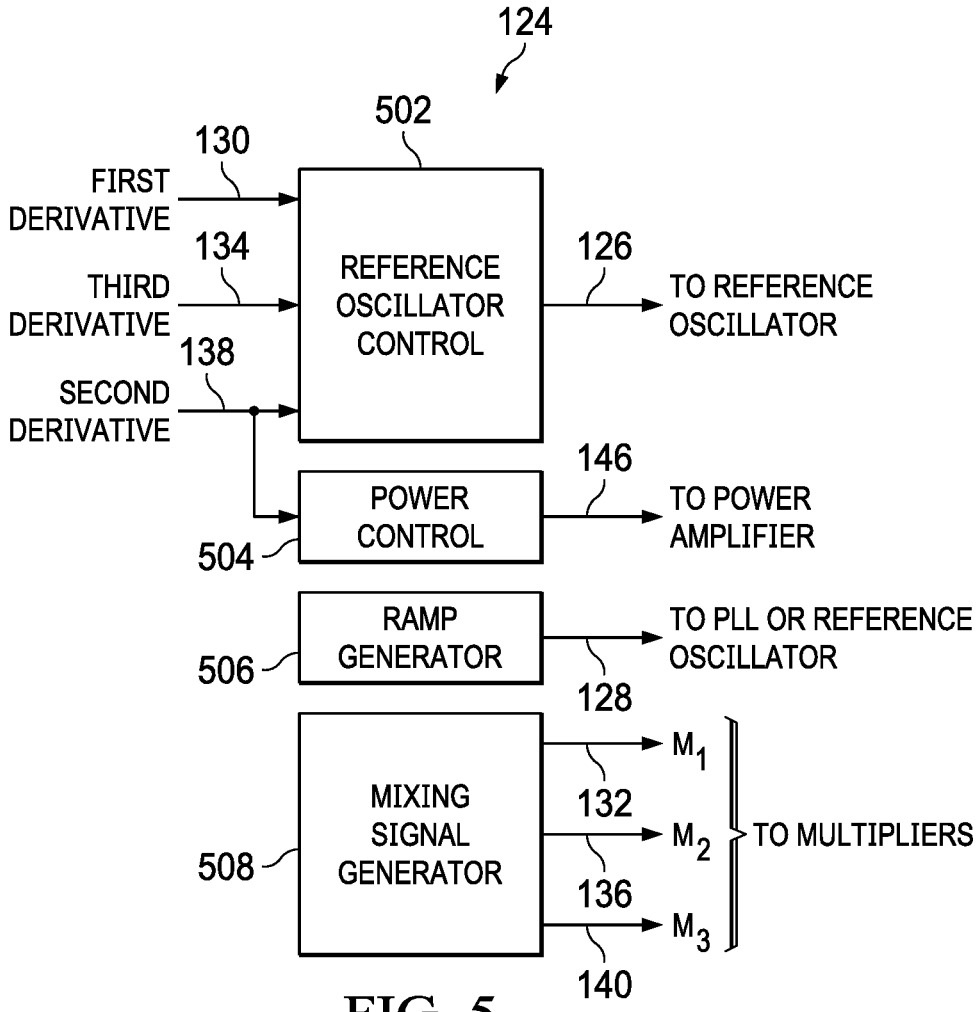
FIG. 5 shows a block diagram for an example controller for a molecular clock generator in accordance with this description.

FIG. 5 shows a block diagram for an example of the controller 124 in accordance with this description. The controller 124 includes reference oscillator control circuitry 502, power control circuitry 504, ramp generator circuitry 506, and mixing signal generation circuitry 508. The reference oscillator control circuitry 502, the power control circuitry 504, the ramp generator circuitry 506, and the mixing signal generation circuitry 508 include circuits to generate control signals including the control signal 126, the ramp control signal 128, and the control signal 146. The ramp generator circuitry 506 includes circuits that generate the ramp control signal 128 that modulates the sweep signal 150 generated by the PLL 110. The ramp control signal 128 may define a linear up or down ramp for use in cancellation of the delay of the detection circuit 119 as described herein. The ramp generator circuitry 506 may include a memory that stores the digitized values of a ramp waveform and circuitry that reads the values from memory to generate the ramp control signal 128.

The mixing signal generation circuitry 508 generates the mixer signal 132, the mixer signal 136, and the mixer signal 140. The mixing signal generation circuitry 508 may generate the mixer signal 132, the mixer signal 136, and mixer signal 140 based on the ramp control signal 128. For example, the mixing signal generation circuitry 508 may generate the transitions of the mixer signal 132, the mixer signal 136, and mixer signal 140 based on addressing or clocking applied to generate the ramp control signal 128.

The reference oscillator control circuitry 502 and the power control circuitry 504 apply the first derivative signal 130, the second derivative signal 134, and/or the third derivative signal 138 to generate the control signal 126 for controlling the reference oscillator 108 and to generate the control signal 146 for controlling the power amplifier 112. For example, the reference oscillator control circuitry 502 includes circuitry to identify the absorption peak ($f_{dip}$) of the dipolar molecule 104 (and measure the time of occurrence thereof) based on the first derivative signal 130, the second derivative signal 134, and/or the third derivative signal 138 of the output of the mixer 114. Having measured the time of occurrence of the absorption peaks in two successive sweeps of the cavity 102 (e.g., an up ramp and a down ramp), the reference oscillator control circuitry 502 computes the difference of the two times to cancel the delay of the detection circuit 119, and generates the control signal 126 based on the difference. For example, the control signal 126 may be adjusted to move the difference of the two absorption peaks to a predetermined time that corresponds to the frequency of the reference oscillator 108 being at a predetermined fraction of the frequency of the absorption peak.

The power control circuitry 504 includes circuitry to generate the control signal 146 for controlling the output power of the power amplifier 112 based on the second derivative of the ADC output signal 142. Implementations of the power control circuitry 504 apply the peak of the amplitude of the second derivative to stabilize the power of the electromagnetic field in the cavity 102 by controlling the output power of the power amplifier 112.

Some implementations of the molecular clock generator 100 may combine analog and digital circuitry to provide the functionality described herein. For example, the ramp generation may be digital, and the reference oscillator control or the power amplifier control may be analog.

Figure 6:
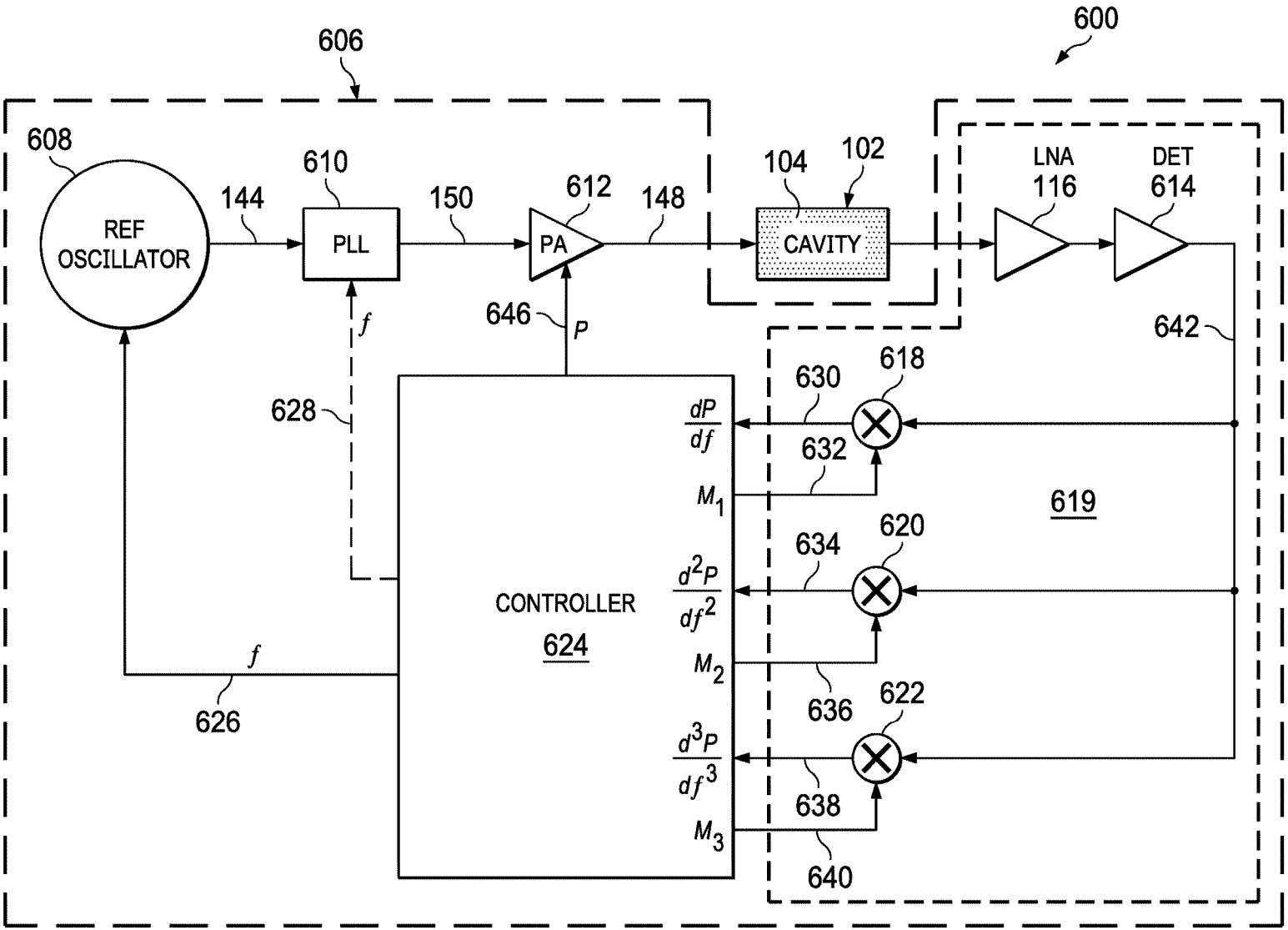
FIG. 6 shows a block diagram for an example molecular clock generator in accordance with description.

FIG. 6 shows a block diagram for an example molecular clock generator 600 in accordance with this description. The molecular clock generator 600 is similar to the molecular clock generator 100, but includes analog multipliers, rather than digital, multipliers. The molecular clock generator 600 includes the cavity 102 that contains the dipolar molecule 104, and includes clock generation circuitry 606 that interrogates the dipolar molecule 104.

The clock generation circuitry 606 includes circuitry that drives electromagnetic signal into the cavity 102, receives electromagnetic signal from the cavity 102, and generates an oscillator signal locked to an absorption peak of the dipolar molecule 104 disposed in the cavity 102. More specifically, the clock generation circuitry 606 includes a reference oscillator 608, a phase-locked-loop (PLL) 610, a power amplifier 612, a detection circuit 619, and a controller 624. The detection circuit 619 is coupled to the cavity 102 and the controller 124. The detection circuit 619 includes the LNA 116, an amplitude detector circuit 614, a multiplier 618, a multiplier 620, and a multiplier 622. Some implementations of the clock generation circuitry 606 include a mixer rather than the amplitude detector circuit 614.

The reference oscillator 608 is an oscillator that is adjustable via the control signal 626. The control signal 626 may be an analog signal in some implementations of the clock generation circuitry 606. The reference oscillator 108 may be a crystal oscillator having an output frequency that can be varied over a narrow range by changing the control signal 626. In various implementations, the reference oscillator 608 is a voltage-controlled crystal oscillator (VCXO), a voltage-controlled temperature compensated crystal oscillator (VCTCXO), or a voltage-controlled oscillator (VCO). The output 144 of the reference oscillator 608 is provided to the PLL 610. The output 144 of the reference oscillator 608 may also be provided to a driver circuit (not shown) for provision to circuits external to the molecular clock generator 600.

The PLL 610 is coupled to the reference oscillator 608, and includes circuits to multiply the frequency of the output 144 up to a range that includes the frequency of the selected absorption peak of the dipolar molecule 104. The PLL 610 may include a phase detector, a filter, counters, and other circuitry for PLL frequency multiplication. The output frequency of the PLL 610 can also be varied by a ramp control signal 628. For example, the output frequency of the PLL 610 may be centered at a fixed multiple of the frequency of the output 144 and varied over a range that includes frequencies below and above the center frequency by changing the ramp control signal 628. In various implementations, the ramp control signal 628 may change a divider value in the PLL 610 or modulate a VCO control voltage in the PLL 610. In this way, the PLL 610 may generate a frequency sweep about the absorption peak of the dipolar molecule 104. The sweep signal 150 of the PLL 610 is provided to the power amplifier 612.

The power amplifier 612 is coupled to the PLL 610 and the cavity 102, and includes circuitry for amplifying the sweep signal 150 of the PLL 610 and driving the cavity 102. The power amplifier 612 may include circuitry for applying voltage gain and/or current gain to the sweep signal 150 of the PLL 610. The output power of the power amplifier 612 is variable via the control signal 646. Some implementations of the 606 may omit the power amplifier 612. For example, if the output power of the PLL 610 is sufficient to drive the cavity 102, then the PLL 610 may be omitted.

The cavity 102 includes an input port and an output port. The electromagnetic signal generated by the power amplifier 612 propagates through the cavity 102 from the input port to the output port. The dipolar molecule 104 has an absorption peak at a frequency of quantum rotational state transition that reduces the amplitude of the electromagnetic signal at the output port at the absorption peak. The LNA 116 is coupled to the output port of the cavity 102. The LNA 116 amplifies the signal received from the cavity 102, and provides an amplified LNA output signal to the amplitude detector circuit 614. Some implementations of the 606 may omit the LNA 116. For example, if the output power of the cavity 102 is sufficient to drive the amplitude detector circuit 614, then the LNA 116 may be omitted.

The amplitude detector circuit 614 receives the amplified LNA output signal and generates an envelope signal corresponding to the amplitude of the output of the cavity 102. Some implementations of the detection circuit 619 may include the mixer 114 rather than the amplitude detector circuit 614.

Output of the amplitude detector circuit 614 is provided to the multiplier 618, the multiplier 620, and the multiplier 622. The multiplier 618, the multiplier 620, and the multiplier 622 are analog multiplication circuits. The multiplier 618 multiples the amplitude detector output signal 642 by a mixer signal 632. The average of the product of the amplitude detector output signal 642 and the mixer signal 632 is the first derivative 630 of the amplitude detector output signal 642. The multiplier 620 multiples the amplitude detector output signal 642 by a mixer signal 636. The average of the product of the amplitude detector output signal 642 and the mixer signal 636 is the second derivative 634 of the amplitude detector output signal 642. The multiplier 622 multiples the amplitude detector output signal 642 by a mixer signal 640. The average of the product of the amplitude detector output signal 642 and the mixer signal 640 is the third derivative 638 of the amplitude detector output signal 642.

The multiplier 618, the multiplier 620, and the multiplier 622 are coupled to the controller 624. In some implementations of the molecular clock generator 600, the multiplier 618, the multiplier 620, and the multiplier 622 are included in the controller 624. The controller 624 provides the mixer signal 632, the mixer signal 636, and the mixer signal 640 to the multiplier 618, the multiplier 620, and the multiplier 622 respectively. The controller 624 receives the first derivative 630 generated by the multiplier 618, the second derivative 634 generated by the multiplier 620, and the third derivative 638 generated by the multiplier 622. The controller 624 applies the first derivative 630, the second derivative 634, and the third derivative 638 to control the reference oscillator 608, the PLL 610, and the power amplifier 612.

Like the controller 124, the controller 624 measures the timing of the absorption peak in a way that compensates for the delay of the detection circuit 619. The controller 624 generates a first instance of the ramp control signal 628 that causes the sweep signal 150 to sweep across $f_{dip}$ from a lower frequency to a higher frequency (i.e., an up ramp in frequency), and generates a second instance of the ramp control signal 628 that causes the sweep signal 150 to sweep across $f_{dip}$ from a higher frequency to a lower frequency (i.e., a down ramp in frequency). The controller 624 measures the time from initiation of each sweep to the absorption peak, computes the difference of the measured absorption peak times to cancel the delay of the detection circuit 619, and sets the reference oscillator 608 based on the difference value.

Figure 7:
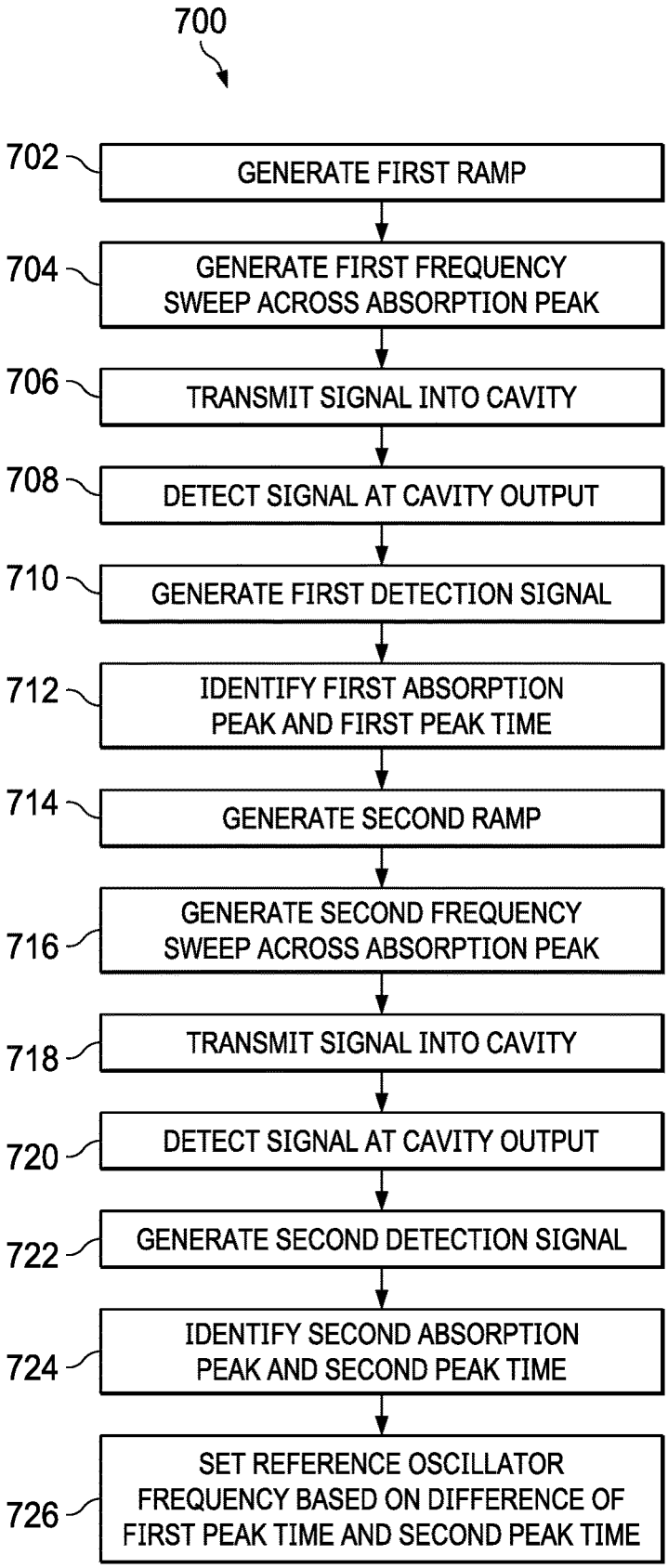
FIG. 7 shows a flow diagram for an example method for generating a clock signal in a molecular clock generator in accordance with this description.

FIG. 7 shows a flow diagram for an example method 700 for generating a clock signal in a molecular clock generator in accordance with this description. Though depicted sequentially as a matter of convenience, at least some of the actions shown can be performed in a different order and/or performed in parallel. Additionally, some implementations may perform only some of the actions shown. Operations of the method 700 may be performed by an implementation of the molecular clock generator 100.

In block 702, the controller 124 generates a first ramp (e.g., an up ramp) to modulate the frequency of the sweep signal 150 generated by the PLL 110. The ramp is provided to the PLL 110 as the ramp control signal 128.

In block 704, the ramp control signal 128 causes the PLL 110 to sweep the frequency of a signal driven into the cavity 102 over a range about the absorption peak of the dipolar molecule 104. For example, the PLL 110 may sweep the frequency of the sweep signal 150 over a range as illustrated by the sweep signal 402 of FIG. 4A.

In block 706, the sweep signal 150 generated by the PLL 110 is transmitted into the cavity 102 by the power amplifier 112.

In block 708, the detection circuit 119 detects electromagnetic signal at an output port of the cavity 102. The signal detected corresponds to the signal transmitted into the cavity with amplitude attenuation at the absorption peak of the dipolar molecule 104.

In block 710, the detection circuit 119 generates an output signal that corresponds to the power of the signal detected at the output port of the cavity 102.

In block 712, an output signal generated by the detection circuit 119 is provided to the controller 124. The controller 124 identifies a first absorption peak resulting from the first ramp and a first time at which the first absorption peak occurs.

In block 714, the controller 124 generates a second ramp (e.g., a down ramp) to modulate the frequency of the sweep signal 150 generated by the PLL 110. The ramp is provided to the PLL 110 as the ramp control signal 128.

In block 716, the ramp control signal 128 causes the PLL 110 to sweep the frequency of a signal driven into the cavity 102 over a range about the absorption peak of the dipolar molecule 104. For example, the PLL 110 may sweep the frequency of the sweep signal 150 over a range as illustrated by the sweep signal 404 of FIG. 4A.

In block 718, the sweep signal generated by the PLL 110 is transmitted into the cavity 102 by the power amplifier 112.

In block 720, the detection circuit 119 detects electromagnetic signal at the output port of the cavity 102. The signal detected corresponds to the signal transmitted into the cavity with amplitude attenuation at the absorption peak of the dipolar molecule 104.

In block 722, the detection circuit 119 generates an output signal that corresponds to the power of the signal detected at the output port of the cavity 102.

In block 724, the output signal generated by the detection circuit 119 is provided to the controller 124. The controller 124 identifies a second absorption peak resulting from the second ramp and a second time at which the second absorption peak occurs.

In block 726, the controller 124 computes a difference of the first time measured in block 712 and the second time measured in block 724. Taking the difference of the first time and the second time cancels the effects of delay in the detection circuit 119, and maintains frequency drift of the reference oscillator 108. The controller 124 sets the frequency of the reference oscillator 108 based on the difference of the first time and the second time.

Modifications are possible in the described embodiments, and other embodiments are possible, within the scope of the claims.

What is claimed is:

1. A clock generator, comprising:

a hermetically sealed cavity;

a dipolar molecule in the hermetically sealed cavity, the dipolar molecule having a quantum rotational state transition at a fixed frequency; and clock generation circuitry configured to generate an output clock signal based on the fixed frequency of the dipolar molecule, the clock generation circuitry comprising:

a detection circuit coupled to the hermetically sealed cavity, the detection circuit configured to:

generate a first detection signal representative of an amplitude of a signal at an output of the hermetically sealed cavity responsive to a first sweep signal input to the hermetically sealed cavity; and generate a second detection signal representative of the amplitude of the signal at the output of the hermetically sealed cavity responsive to a second sweep signal input to the hermitically sealed cavity;

a reference oscillator configured to generate an oscillator signal based on the fixed frequency of the dipolar molecule; and control circuitry coupled to the detection circuit and the reference oscillator, and configured to set a frequency of the reference oscillator based on a difference in a time of identification of the fixed frequency of the dipolar molecule in the first detection signal and a time of identification of the fixed frequency of the dipolar molecule in the second detection signal.

2. The clock generator of claim 1, wherein the clock generation circuitry comprises a phase locked loop (PLL) coupled to the hermetically sealed cavity, and configured to generate the first sweep signal and the second sweep signal.

3. The clock generator of claim 1, wherein the first sweep signal increases in frequency, and the second sweep signal decreases in frequency.

4. The clock generator of claim 1, wherein the control circuitry is configured to:

measure a first time from initiation of the first sweep signal to identification of the fixed frequency of the dipolar molecule in the first detection signal;

measure a second time from initiation of the second sweep signal to identification of the fixed frequency of the dipolar molecule in the second detection signal; and set the frequency of the reference oscillator based on a difference of the first time and the second time.

5. The clock generator of claim 1, wherein the first sweep signal comprises a positive linear frequency ramp and the second sweep signal comprises a negative linear frequency ramp.

6. The clock generator of claim 1, wherein the first sweep signal immediately precedes the second sweep signal.

7. The clock generator of claim 1, wherein the reference oscillator is configured to generate the first sweep signal and the second sweep signal.

8. A method for clock generation, comprising:

transmitting a first sweep signal into a hermetically sealed cavity, wherein the hermetically sealed cavity contains a dipolar molecule that has a quantum rotational state transition at a fixed frequency;

transmitting a second sweep signal into the hermetically sealed cavity;

detecting a first output of the hermetically sealed cavity produced responsive to the first sweep signal; and generating a first detection signal representative of an amplitude of the first output of the hermetically sealed cavity;

detecting a second output of the hermetically sealed cavity produced responsive to the second sweep signal; and generating a second detection signal representative of an amplitude of the second output of the hermetically sealed cavity; and setting a frequency of a reference oscillator based on a difference in a time of identification of the fixed frequency of the dipolar molecule in the first detection signal and a time of identification of the fixed frequency of the dipolar molecule in the second detection signal.

9. The method of claim 8, further comprising:

generating a first ramp control signal;

applying the first ramp control signal to generate the first sweep signal;

generating a second ramp control signal; and applying the second ramp control signal to generate the second sweep signal.

10. The method of claim 9, further comprising providing the first ramp control signal and the second ramp control signal to a phase locked loop to generate the first sweep signal and the second sweep signal.

11. The method of claim 9, further comprising providing the first ramp control signal and the second ramp control signal to the reference oscillator to generate the first sweep signal and the second sweep signal.

12. The method of claim 8, wherein the first sweep signal increases in frequency, and the second sweep signal decreases in frequency.

13. The method of claim 8, further comprising:

measuring a first time from initiation of the first sweep signal to identification of the fixed frequency of the dipolar molecule in the first detection signal;

measuring a second time from initiation of the second sweep signal to identification of the fixed frequency of the dipolar molecule in the second detection signal; and setting the frequency of the reference oscillator based on a difference of the first time and the second time.

14. The method of claim 8, wherein the first sweep signal comprises a positive linear frequency ramp and the second sweep signal comprises a negative linear frequency ramp.

15. The method of claim 8, wherein the first sweep signal immediately precedes the second sweep signal.

16. A clock generator, comprising:

a hermetically sealed cavity;

a dipolar molecule in the hermetically sealed cavity, the dipolar molecule having a quantum rotational state transition at a fixed frequency; and clock generation circuitry configured to generate an output clock signal based on the fixed frequency of the dipolar molecule, the clock generation circuitry comprising:

a reference oscillator configured to generate an oscillator signal based on the fixed frequency of the dipolar molecule;

a phase-locked-loop (PLL) coupled to the reference oscillator and to the hermetically sealed cavity, the PLL configured to:

generate a first sweep signal; and generate a second sweep signal;

a detection circuit coupled to the hermetically sealed cavity, the detection circuit configured to:

generate a first detection signal representative of an amplitude of a signal at an output of the hermetically sealed cavity responsive to the first sweep signal being input to the hermetically sealed cavity; and generate a second detection signal representative of the amplitude of the signal at the output of the hermetically sealed cavity responsive to the second sweep signal being input to the hermitically sealed cavity; and control circuitry coupled to the detection circuit, the PLL, and the reference oscillator, and configured to set a frequency of the reference oscillator based on a difference in a time of identification of the fixed frequency of the dipolar molecule in the first detection signal and a time of identification of the fixed frequency of the dipolar molecule in the second detection signal.

17. The clock generator of claim 16, wherein the first sweep signal increases in frequency, and the second sweep signal decreases in frequency.

18. The clock generator of claim 16, wherein the control circuitry is configured to:

measure a first time from initiation of the first sweep signal to identification of the fixed frequency of the dipolar molecule in the first detection signal;

measure a second time from initiation of the second sweep signal to identification of the fixed frequency of the dipolar molecule in the second detection signal; and set the frequency of the reference oscillator based on a difference of the first time and the second time.

19. The clock generator of claim 16, wherein the first sweep signal comprises a positive linear frequency ramp and the second sweep signal comprises a negative linear frequency ramp.

20. The clock generator of claim 16, wherein the first sweep signal immediately precedes the second sweep signal.

* * * * *